US007156679B1

(12) United States Patent
Wang et al.

(10) Patent No.: US 7,156,679 B1
(45) Date of Patent: Jan. 2, 2007

(54) MODULE CONNECTOR

(75) Inventors: Chin Chou Wang, Tucheng (TW); Kao Yi Chiu, Tucheng (TW); Chung Hsin Huang, Tucheng (TW)

(73) Assignee: Chen Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/305,117

(22) Filed: Dec. 19, 2005

(30) Foreign Application Priority Data

Jan. 28, 2005 (TW) ..... 94201629 U

(51) Int. Cl.
*H01R 13/62* (2006.01)

(52) U.S. Cl. ..... 439/330

(58) Field of Classification Search ..... 439/330, 439/73, 71, 358, 70
See application file for complete search history.

(56) References Cited

U.S. PATENT DOCUMENTS 4,571,015 A * 2/1986 Mueller ..... 439/64

* cited by examiner

*Primary Examiner*—Javaid H. Nasri
(74) *Attorney, Agent, or Firm*—Rosenberg, Klein & Lee

(57) ABSTRACT

The present invention provides a module connector including a housing having four sidewalls that define a chamber for receiving a module therein. Each sidewall defines a plurality of contact recesses. A plurality of contacts is accommodated in the contact recesses and electrically contacts with the module. Pull-out prevention slices are positioned on periphery of the housing. Each pull-out prevention slice has a pressing portion which extends into the chamber and presses on the top of the module downwardly, and an actuating portion which extends upwardly from the pressing portion and is adapted for being manually pulled outward. When the module is needed to be pulled out from the module connector, by pulling the actuating portion outward, the pressing portion is driven to move outward and upwardly with the result that the pressing portion departs from the module to make way to the module for the module being pulled out. Therefore, no special tool is needed, in turn, the module is avoided being scraped.

8 Claims, 7 Drawing Sheets

MODULE CONNECTOR

BACKGROUND OF THE INVENTION

1. Field of the Invention

The present invention generally relates to a module connector, especially to a module connector to retain a digital camera lens module.

2. The Related Art

Nowadays, digital photographing technology is widely used in people's daily life. More and more electronic devices are desired to integrate photographing function thereon. To integrate the photographing function, a digital camera lens module must be assembled to the electronic device. The most common solution to assemble the module is to provide a module connector in the electronic device for fitting the module therein.

Japan patent publication No. 2004-241225 published on Aug. 26, 2004 discloses a module connector for a digital camera lens module. The module connector includes a square box-like housing having an upwardly open chamber with four sidewalls to accommodate the digital camera lens module. Each sidewall holds a plurality of contacts in its inner surface. Each contact extends into the chamber to form a contact projection. When the module is inserted into the chamber, the contact projections prop themselves against sides of the module and pressingly contact with contact pads of the module to prevent the module from moving horizontally relative to the module connector.

The module connector further includes four metal boards. The top of each board bends into a pair of clamping pieces at opposite ends thereof for clamping the corresponding sidewall of the housing. A pull-out prevention piece is formed between the pair of clamping pieces for pressing on the top of the module to prevent the module from moving vertically relative to the module connector.

However, when the digital camera lens module is needed to be pulled out from the module connector, a special tool for pushing the pull-out prevention pieces aside is required, which makes it cumbersome to operate and is easy to damage the module.

SUMMARY OF THE INVENTION

An object of the present invention is to provide a module connector comprising a housing having four sidewalls that define a chamber for receiving a module therein. Each sidewall defines a plurality of contact recesses. A plurality of contacts is accommodated in the contact recesses and electrically contacts with the module. Pull-out prevention slices are positioned on periphery of the housing. Each pull-out prevention slice has a pressing portion which extends into the chamber and pressed on the top of the module downwardly, and an actuating portion which extends upwardly from the pressing portion and is adapted for being manually pulled outward to drive the pressing portion to move outward and upwardly as to depart from the module. When the module is needed to be pulled out from the module connector, by pulling the actuating portion outward, the pressing portion is driven to move outward and upwardly with the result that the pressing portion departs from the module to make way to the module for the module being pulled out. Therefore, no special tool is needed, in turn, the module is avoided being scraped.

Preferably, the module connector further includes a shell having four side-clipping panels wrapping the respective sidewalls of the housing. Each side-clipping panel has a pressing piece extending into the chamber to prop against the side of the module, thereby retaining the module in the module connector tightly and reliably.

Other objects, advantages and novel features of the invention will become more apparent from the following detailed description when taken in conjunction with the accompanying drawings.

DETAILED DESCRIPTION OF THE PREFERRED EMBODIMENT

In order to illustrate the present invention particularly, including technology, structure trait, aims and efficiency, a detailed explanation of a preferred embodiment of the present invention will be given thereinafter, with reference to the attached drawing, for better understanding thereof to those skilled in the art.

Figure 1:
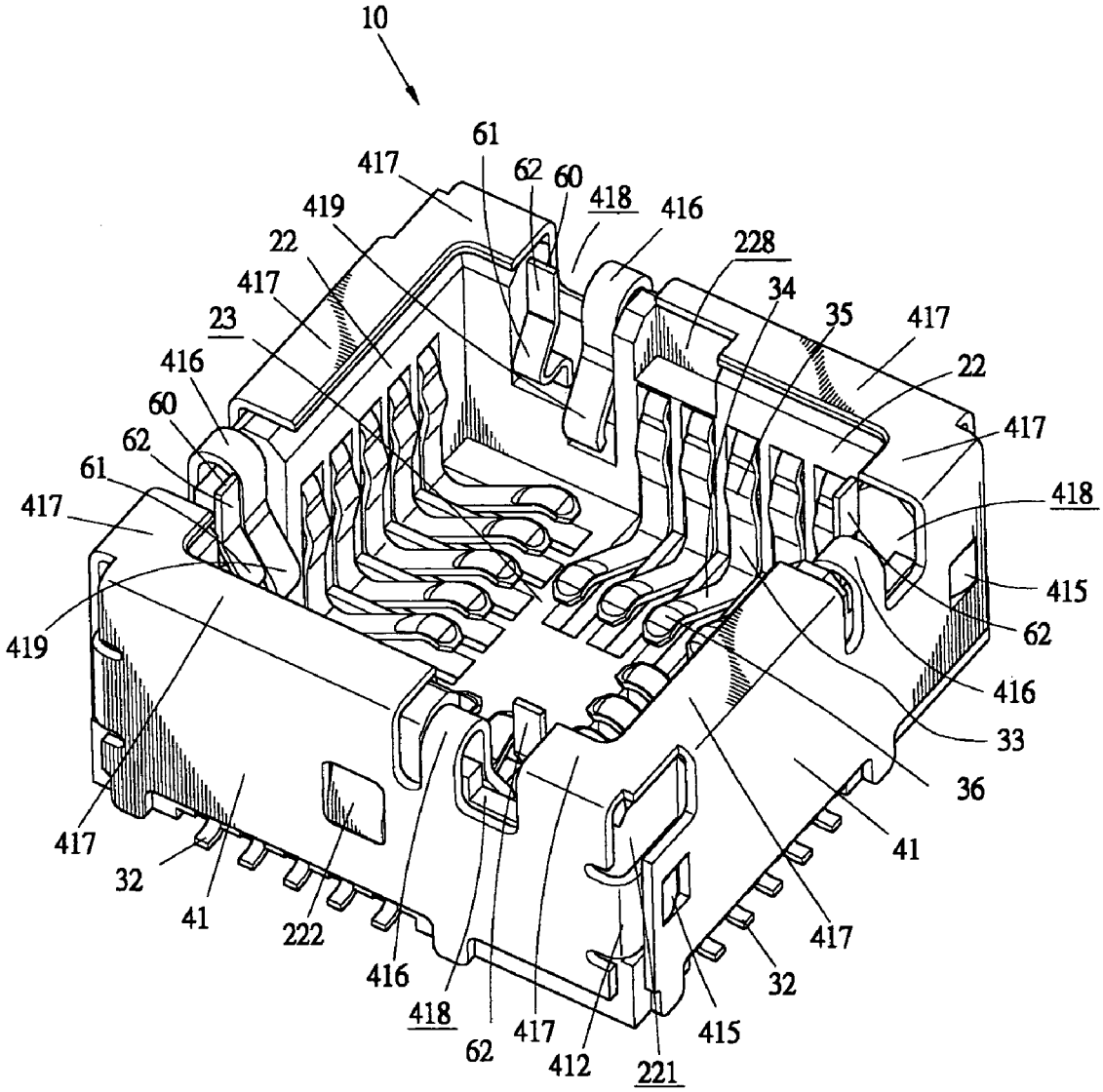
FIG. 1 is an assembled perspective view of a module connector according to the present invention.
Figure 2:
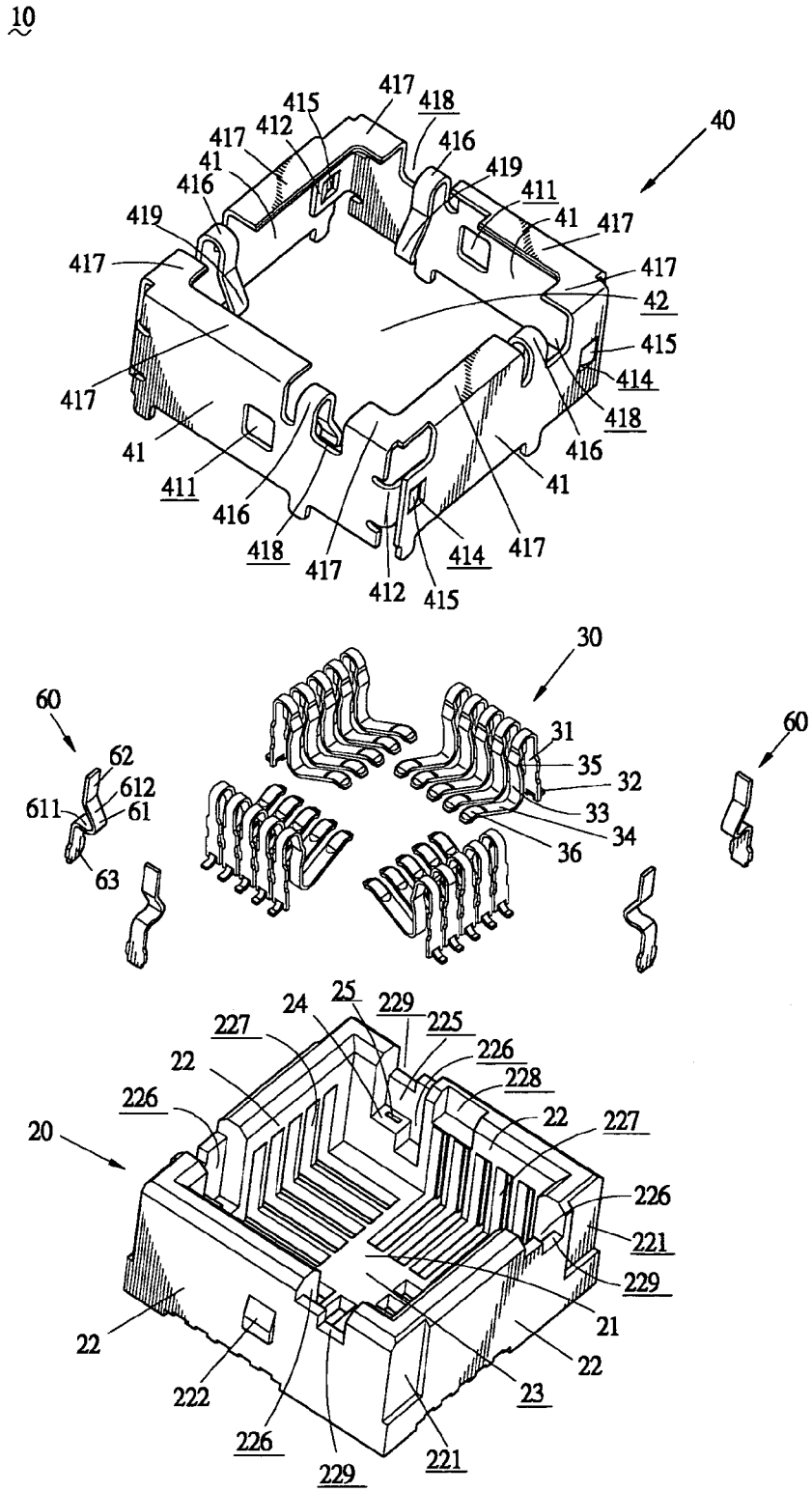
FIG. 2 is an exploded perspective view of the module connector shown in FIG. 1.

Now, referring to FIGS. 1 and 2, the module connector 10 of the present invention includes a housing 20 receiving a plurality of contacts 30 and four pull-out prevention slices 60 therein, and a shell 40 wrapping the housing 20.

The housing 20 includes a square bottom board 21 and four sidewalls 22 extending perpendicularly and upwardly from four edges of the bottom board 21 to define an upwardly-open chamber 23. Embedding recesses 221 are defined in outer sides of the left and the opposite right sidewalls 22. The front sidewall 22 and the opposite rear sidewall 22 respectively have an engagement protrusion 222 projected outwardly on about the middle portions of the outer sides thereof. The inner side of each sidewall 22 defines a pressing recess 225 and a propping recess 226. The top surface of each sidewall defines a first cutout 229 communicating with the pressing recess 225. The inner side of each sidewall 22 has a lump 24 projected into the pressing recess 225. A fixed hole 25 is disposed in the lump 24 and opens to the pressing recess 225. A plurality of parallel grooves 227 are formed in an upper face of the bottom board 21 of the chamber 23, and the contact grooves 227 extend from the central portion of the bottom board 21 to the four sidewalls 22 of the housing 20. Therefore each contact grooves 227 is L-shaped. The rear sidewall 22 further provides a foolproof recess 228 open to the top surface and the inner side thereof.

Each pull-out prevention slice 60 has a pressing portion 61, an actuating portion 62 extending upwardly from the pressing portion 61 and a securing portion 63 extending downwardly from the pressing portion 61. The pressing portion 61 includes a pair of arms 611, 612 one of which extends transversely and connects the securing portion 63, and the other of which slants upwardly and connects the actuating portion 62.

Each contact 30 has an inverted U-shaped portion with one leg serving as a retention portion 31 to secure the contact 30 in the corresponding contact grooves 227 and the other leg serving as an elastic pressing arm 33. Free end of the retention portion 31 is bent sideward to form a soldering portion 32. Free end of the pressing arm 33 is bent sideward and extends slantingly and upwardly to form a contact arm 34. A touching portion 35 is protruded from the nearly middle of a pressing arm 33 towards the corresponding contact arm 34. A contact portion 36 is formed on the most protrudent portion of the contact arm 34.

The shell 40 including four side-clipping panels 41 is a one-piece component fabricated of metal material. So only one action is needed to assemble such shell 40 with the housing 20 thereby simplifying the assembling of the module connector 10. In the meanwhile, the integrative structure of the shell 40 can enhance the stableness of the assembly. The four side-clipping panels 41 define an accommodating room 42 having an open top end and an open bottom end. The front side-clipping panel 41 and the back side-clipping panel 41 respectively have a hole 411 in the nearly middle part thereof and a pair of locking arms 412 at two sides extending towards the accommodating room 42 with barbs 415 thereon for engagement with mounting holes 414 in the left side-clipping panel 41 and the right side-clipping panel 41. Each side of the shell 40 has a pressing piece 416 and a top cover 417 bent towards the inside of the shell 40. The pressing pieces 416 extend downwardly into the propping recesses 226 and form pressing points 419 projecting towards center of the accommodating room 42. The top of each side-clipping panel 41 defines a second cutout 410 corresponding to the first cutout 229.

Figure 3:
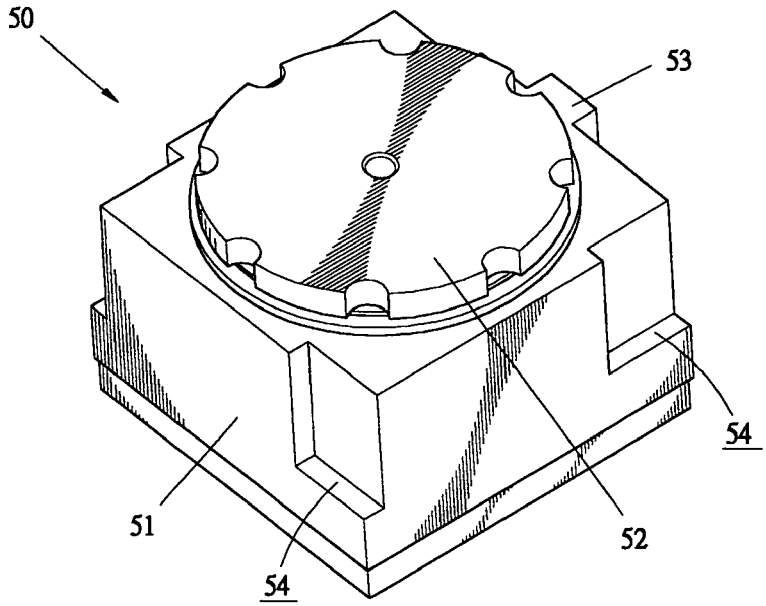
FIG. 3 is a perspective view of a digital camera lens module to be fitted in the module connector.

As illustrated in FIG. 3, a digital camera lens module 50 to be fitted in the module connector 10 comprises a base 51 with a lens base 52 at the top thereof, and recesses 54 in side surfaces of the base 51 corresponding to the pull-out prevention slices 60, a plurality of contact pads (not shown) on the bottom of the lens module 50, and a foolproof protrusion 53 on one side surface of the base 51 for engaging with the foolproof recess 228 of the housing 20.

Figure 4:
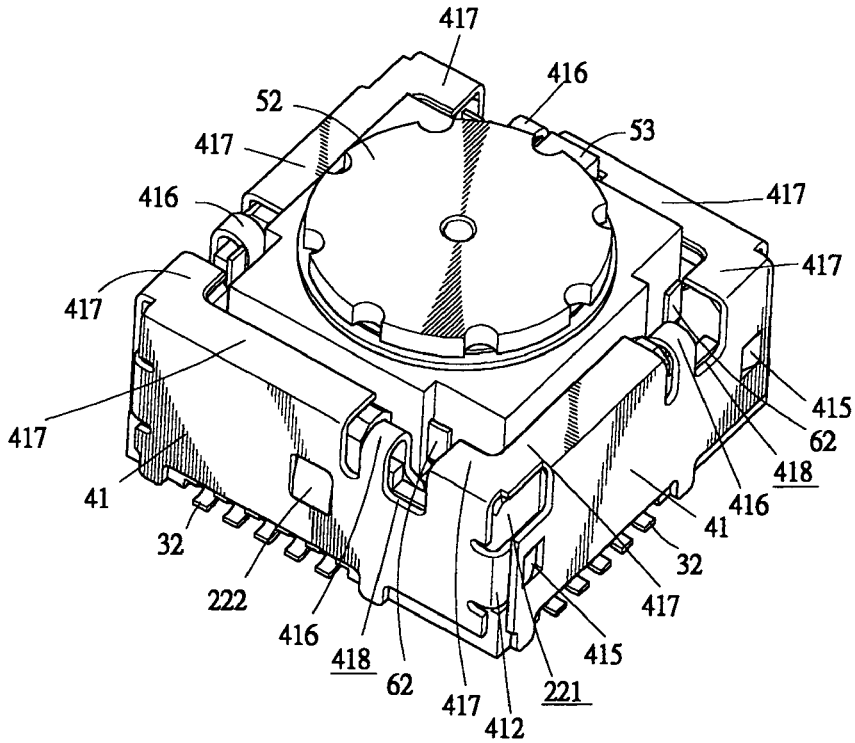
FIG. 4 is a perspective view of the module connector with the digital camera lens module fitted therein.

Please further refer to FIG. 5 to FIG. 8, In assembly, the retention portion 31 of each contact 30 is interferingly engaged with the corresponding contact recess 227 of the housing 20 thereby securing the contact 30 in the contact recess 227. The pressing arm 33 is received in vertical portion of the contact recess 227, and the contact arm 34 is accommodated in the horizontal portion of the contact recess 227. The touching portion 35 of the pressing arm 33 and the contact portion 36 of the contact arm 34 are exposed out of the corresponding contact recess 227 and extend into the chamber 23. The securing portion 63 of each pull-out prevention slice 60 is interferingly inserted into the corresponding fixed hole 25 of the housing 20 to secure the pull-out prevention slice 60 with the rest portion of the slice 60 received in the pressing recess 225. The pressing portion 61 of the pull-out prevention slice 60 extends into the chamber 23. The housing 20 with contacts 30 therein are inserted in the accommodating room 42 of the shell 40 from the open bottom end for receiving the module 50 (as shown in FIG. 4). The second cutout 418 of the shell 40 aligns with the first cutout 229 of the housing 20, whereby providing enough room for pulling the actuating portion 62. The protrusion 222 of the housing 20 is retained in the corresponding hole 411 of the shell 40, whereby the shell 40 is restrained from movement upwardly relative to the housing 20. The top covers 417 of the shell 40 cover the top surfaces of the sidewalls 22 of the housing 20, whereby the shell 40 is restrained from movement downwardly relative to the housing 20. The locking arms 412 of the shell 40 are received in the embedding recesses 221 of the housing 20, whereby the housing 20 is wrapped by the shell 40 tightly. The pressing pieces 416 of the shell 40 each pass through the horizontal portion of the corresponding propping recess 226 and then extend into vertical portion of the propping recess 226. While the pressing points 419 of the pressing pieces 416 extend into the chamber 23, therefore the chamber 23 and the vertical portion of the propping recess 226 provides the pressing points 419 enough space to bias elastically. In addition, in the preferred embodiment, the touching portion 35 of the contact 30 and the pressing point 419 of the pressing piece 416 are in the same height. The pressing portion 61 of the pull-out prevention slice 60 is above the touching portion 35 of the contact 30 and the pressing point 419 of the pressing piece 416.

Figure 5:
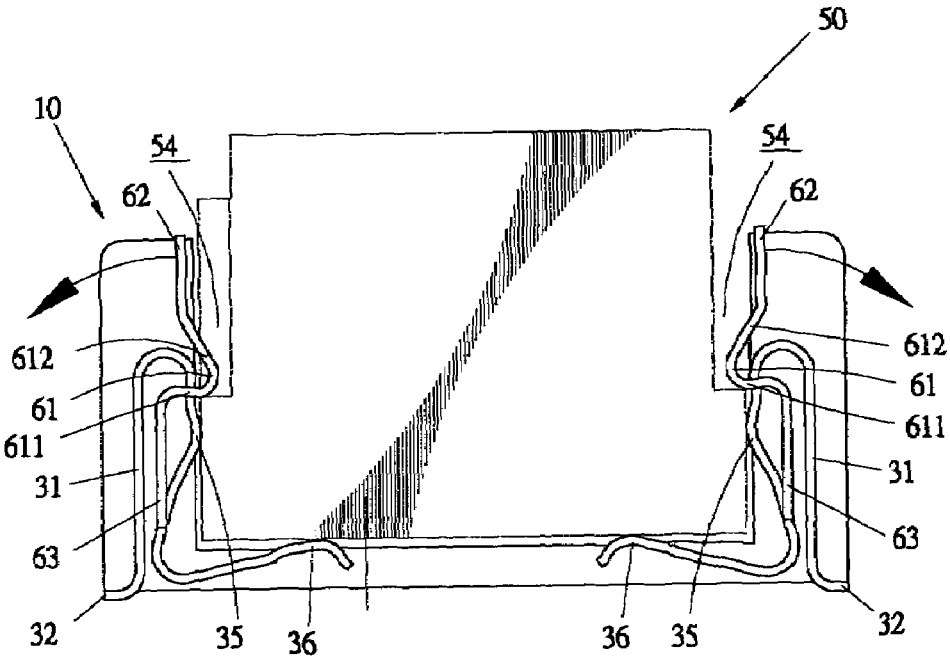
FIGS. 5–8 are diagrammatic representations of disassembling the digital camera lens module from the module connector.
Figure 6:
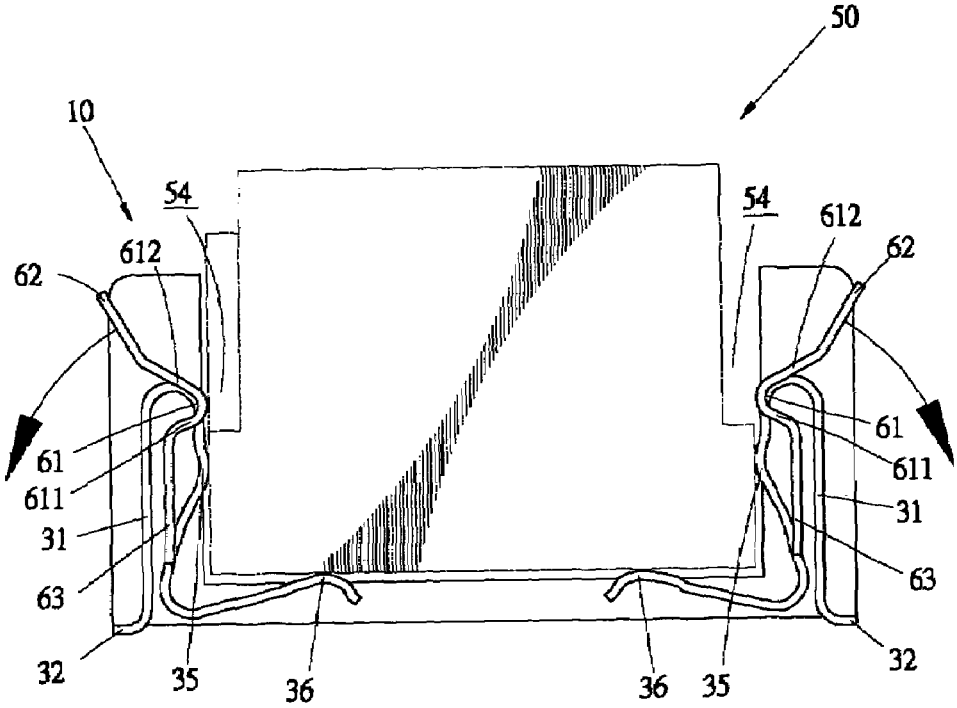

Please refer to FIG. 4 and FIG. 5. To assemble the lens module 50 with the module connector 10, firstly the lens module 50 is embedded in the chamber 23 with the foolproof protrusion 53 of the lens module 50 received in the foolproof recess 228 of the housing 20. In the meantime, the outer side surfaces of the lens module 50 presses the pressing portion 61 of the pull-out prevention slice 60 outward to bias the pressing portion 61 into the pressing recess 225. Then the lens module 50 is continuously pushed into the chamber 23 until the pressing portion 61 coming back into the recess 54 of the lens module 50. At this state, the pressing points 419 of the pressing pieces 416 and the touching portions 35 of the contacts 30 prop against the sides of the base 51 of the lens module 50 to retain the lens module 50 tightly and reliably. In addition, the transverse arm 611 of the pressing portion 61 of the pull-out prevention slice 60 presses on the top of the lens module 50 downwardly to prevent the module 50 from moving up and down. In the preferred embodiment, the transverse arm 611 is arranged horizontally for having large area to contact with the top of the lens module 50, therefore providing enough strength from propping against the lens module 50 and preventing the lens module 50 from being pulled out from the module connector 10 accidentally. The contact portions 36 of the contacts 30 are electrically contacted with the contact pads (not shown) of the lens module 50.

Figure 7:
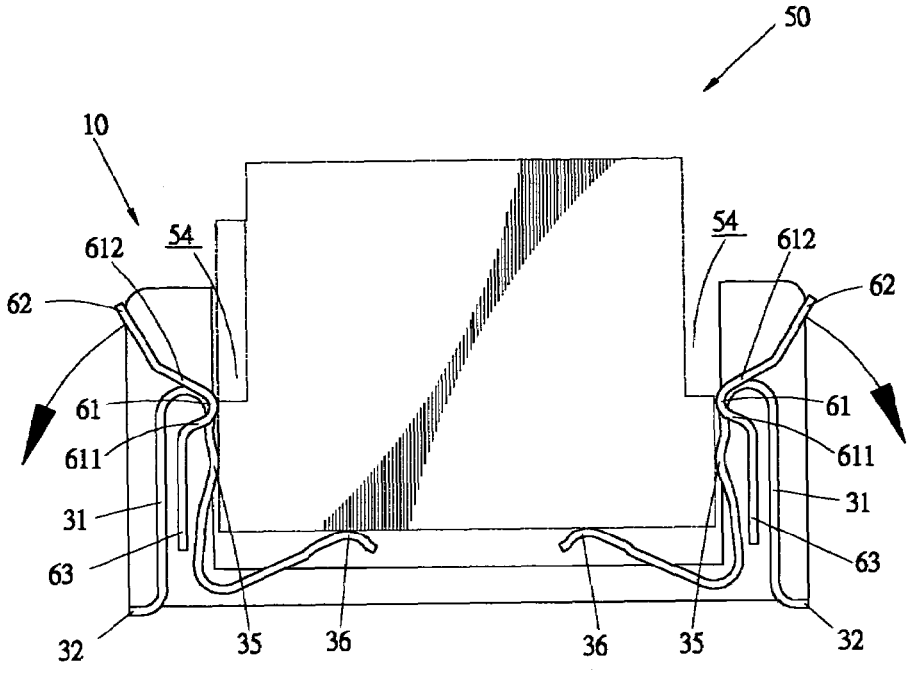
Figure 8:
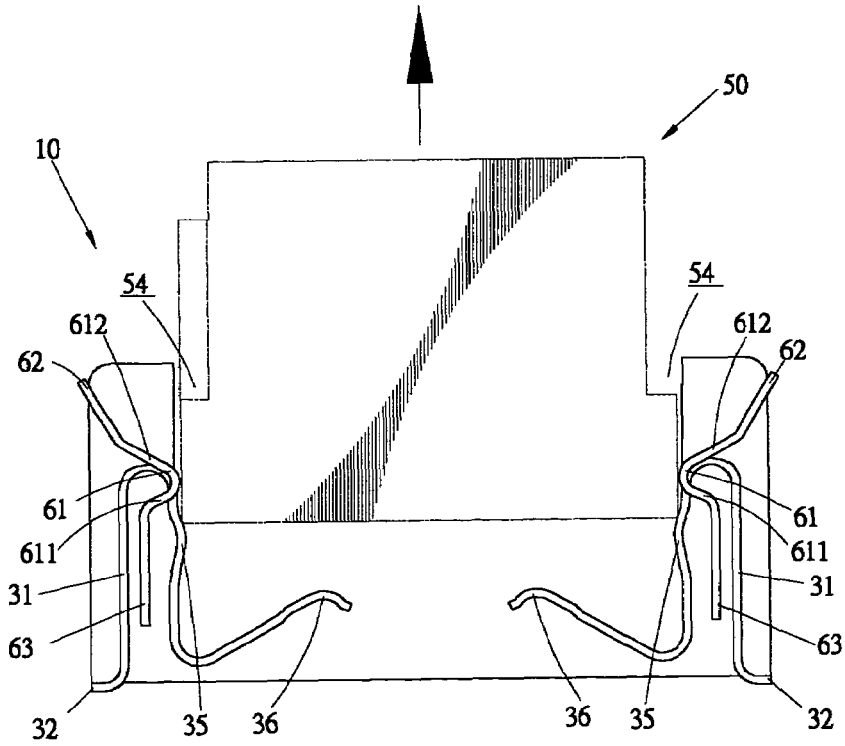

Please refer to FIG. 4 to FIG. 8, when the lens module 50 is required to be taken out from the module connector 10, it can be carried out by the following steps. Firstly, pull the actuating portions 62 of the pull-out prevention slices 60 in the arrow directed direction as shown in FIG. 5, wherein the actuating portions 62 come into the first cutouts 229 and the corresponding second cutout 418, and the pressing portions 61 are driven to move outward and upwardly as to depart from the module 50 to make way to the module 50 for the module 50 being pulled out. After the pressing portions 61 departs form the lens module 50, the recovering force of the contact arm 34 pushes the lens module 50 to move upwardly a certain distance as shown in FIG. 7. Finally, pull the lens module 50 in the arrow directed direction as shown in FIG. 8, thereby the lens module 50 is taken out from the module connector 10. Accordingly, it is convenient to take the lens module 50 out without any damage to the lens module 50 due to without using any special tool.

As mentioned above, no special tool is used during disassembling of the module connector 10. Moreover, the pressing portions 61 are moved upwardly and outward to depart from the lens module 50, thereby avoiding scraping the module.

Figure 9:
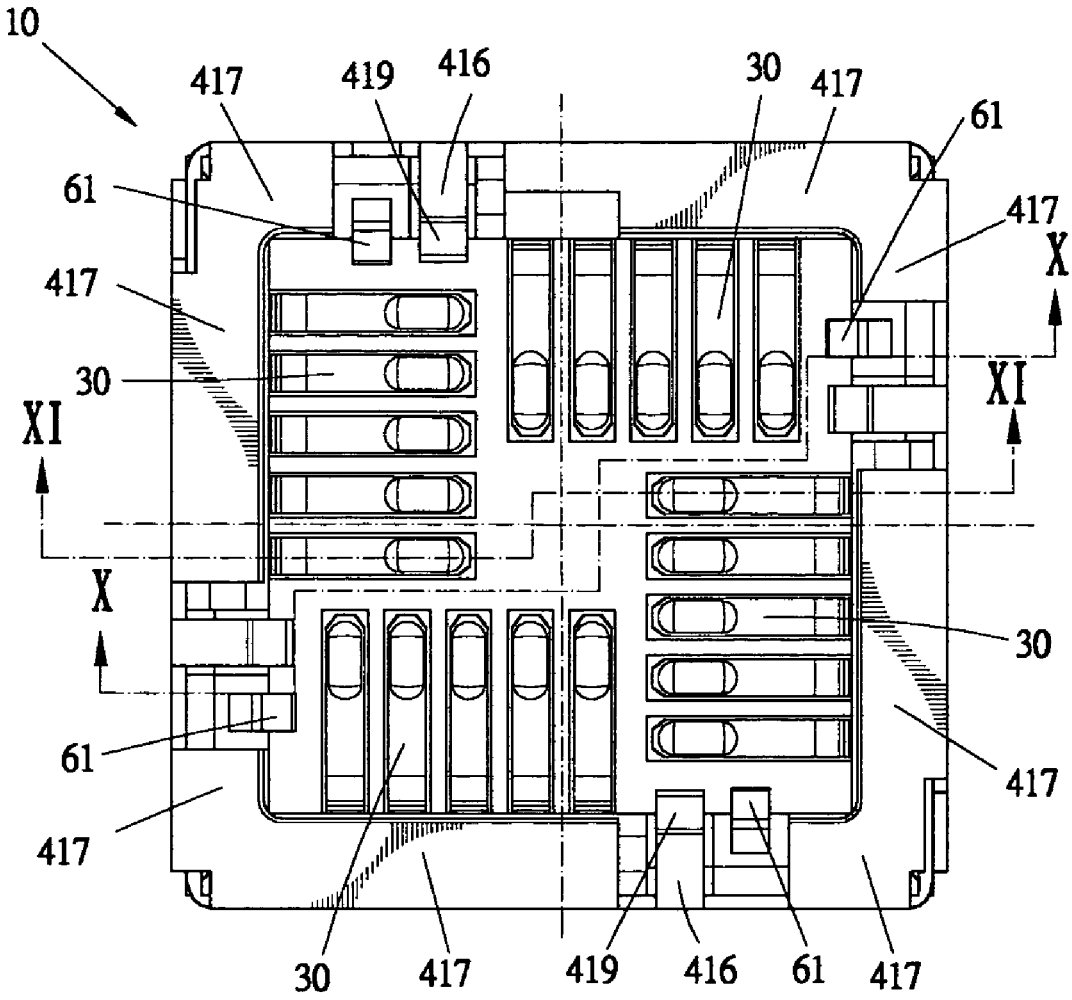
FIG. 9 is a top plan view of the module connector shown in FIG. 1.
Figure 10:
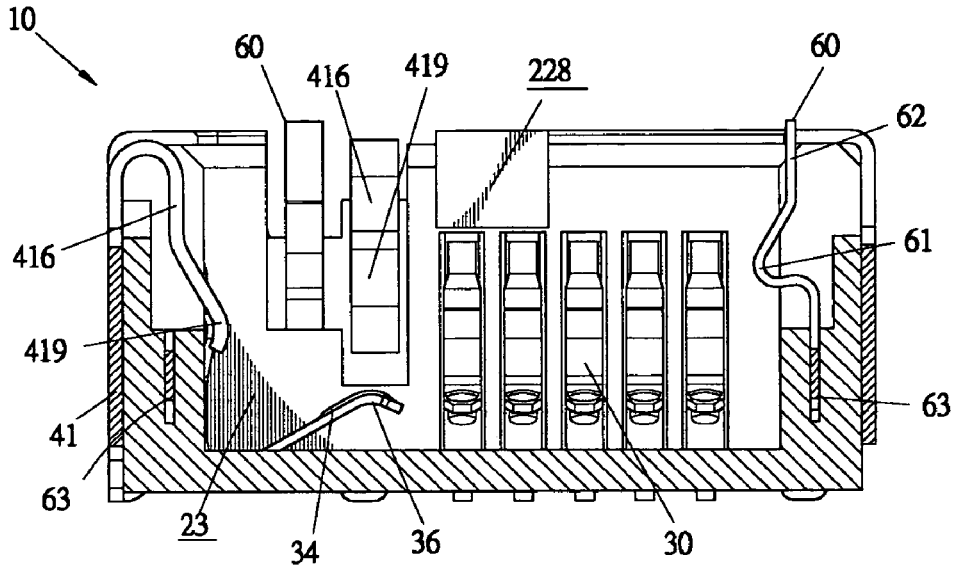
FIG. 10 is a cross-sectional view of the module connector taken along line X—X of FIG. 9.
Figure 11:
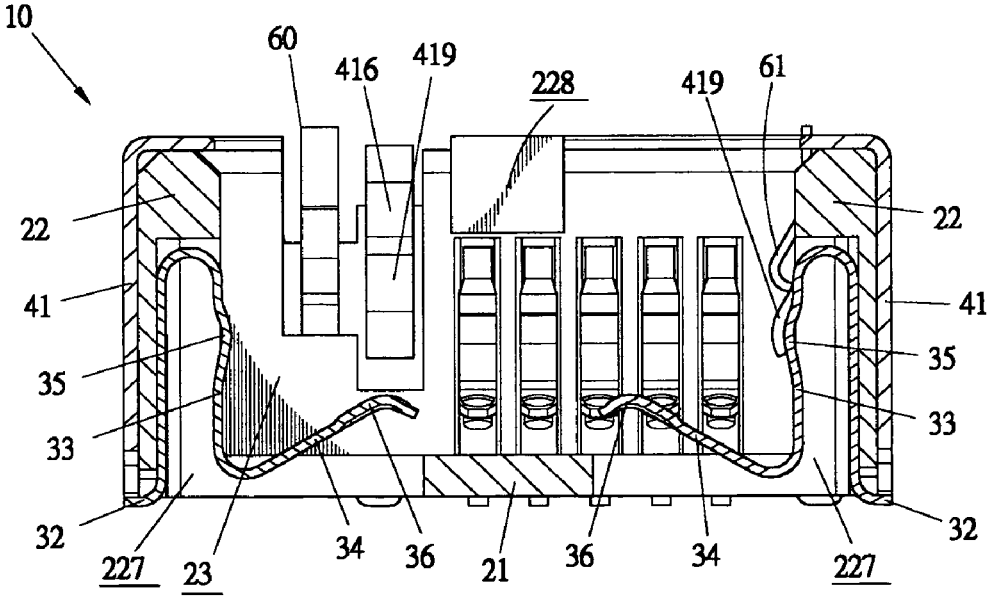
FIG. 11 is a cross-sectional view of the module connector taken along line XI—XI of FIG. 9.

Further refer to FIG. 9 to FIG. 11. The dash dotted lines shown in FIG. 9 are central lines of the respective four sides of the lens module 50. As FIG. 9 illustrated, there are four contacts 30 configured on one side of each central line and one contact 30 and one pressing piece 416 configured on the other side of each central line. As FIG. 10 illustrated, the shell 40 wraps the outer of the housing 20, made the pressing piece 416 of the shell 40 has enough horizontal offset; as FIG. 11 illustrated, the contact 30 is received in the sidewalls 22 of the housing 20, made the touching portion 35 of the contact have little horizontal offset, so that the propping force from each pressing piece 416 against the lens module 50 is obviously bigger than the propping force from each contact 30 against the lens module 50. In the optimum state, the total moment to the lens module 50 from each pressing piece 416 and the corresponding contact 30 on one side of a central line is equal to the total moment from the other four contacts 30 on the other side of the central line, so the torque of each side of the lens module 50 is zero, thereby preventing the lens module 50 from rotating in the horizontal direction.

While the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

What is claimed is:

1. A module connector, comprising:

a housing having four sidewalls which define an upwardly-open chamber adapted for receiving a module therein, each sidewall having a plurality of contact recesses;

a plurality of contacts received in the respective contact recesses of the housing and electrically contacting with contact pads of said module;

pull-out prevention clips positioned on periphery of the housing, each pull-out prevention clip having a pressing portion which extends into the chamber and presses on the top of the module downwardly, and an actuating portion which extends upwardly from the pressing portion and is adapted for being manually pulled outward to drive the pressing portion to move outward and upwardly as to depart from the module; and, a shell integrally formed having four side-clipping panels wrapping the respective sidewalls of the housing, and each side-clipping panel has a pressing piece extending into the chamber to prop against the side of the module.

2. The module connector as claimed in claim 1, wherein the shell is a one-piece component fabricated of metal material.

3. The module connector as claimed in claim 1, wherein each contact has a touching portion extending into the chamber to prop against the side of the module.

4. The module connector as claimed in claim 3, wherein the contacts and the pressing pieces are arranged that the torque of each side of a lens module is almost equal to zero.

5. The module connector as claimed in claim 3, wherein each contact has an inverted U-shaped portion with one leg serving as a retention portion and the other leg serving as an elastic pressing arm, free end of the pressing arm is bent sideward and extends slantingly and upwardly to form a contact arm, the touching portion is protruded from the pressing arm.

6. The module connector as claimed in claim 1, wherein each pull-out prevention clip further has a securing portion extending downwardly from the pressing portion for securing the pull-out prevention clip to the sidewall of the housing.

7. The module connector as claimed in claim 6, wherein the pressing portion includes a pair of arms one of which extends transversely and connects the securing portion, and the other of which slants upwardly and connects the actuating portion.

8. The module connector as claimed in claim 6, wherein pressing recesses are defined in the sidewalls of the housing for receiving the pull-out prevention clip.

* * * * *